US008070533B1

(12) United States Patent
Tai et al.

(10) Patent No.: US 8,070,533 B1
(45) Date of Patent: Dec. 6, 2011

(54) POWER CONNECTOR WITH IMPROVED LOCKING MEMBER EXPOSED TO THE EXTERIOR

(75) Inventors: Hung-Chi Tai, Jhonghe (TW); Zhi-Qiang Rong, Taicang (CN)

(73) Assignee: Alltop Electronics (Suzhou) Co., Ltd., Taicang (CN)

( * ) Notice: Subject to any disclaimer, the term of this patent is extended or adjusted under 35 U.S.C. 154(b) by 0 days.

(21) Appl. No.: 12/939,027

(22) Filed: Nov. 3, 2010

(30) Foreign Application Priority Data

Jul. 9, 2010 (CN) ..... 2010 1 0223665

(51) Int. Cl.
*H01R 24/00* (2006.01)

(52) U.S. Cl. ..... 439/681

(58) Field of Classification Search ..... 439/681, 439/680

See application file for complete search history.

(56) References Cited

U.S. PATENT DOCUMENTS 4,790,763 A * 12/1988 Weber et al. ..... 439/65
6,302,745 B1 * 10/2001 Landis et al. ..... 439/681
7,264,517 B1 * 9/2007 Piromalli et al. ..... 439/681
7,331,828 B2 * 2/2008 Allison ..... 439/681
7,442,093 B2 * 10/2008 Li et al. ..... 439/681
7,491,092 B2 * 2/2009 Zhu et al. ..... 439/633
2010/0087100 A1 4/2010 De Blieck et al.

* cited by examiner

*Primary Examiner* — Gary F. Paumen

(74) *Attorney, Agent, or Firm* — Sughrue Mion, PLLC

(57) ABSTRACT

A power connector includes an insulative housing, a power contact retained in the insulative housing and a key member. The insulative housing defines a receiving chamber recessed from a mating face and a rear portion located at the rear of the receiving chamber. The rear portion defines a mounting hole in communication with the receiving chamber and a first locking arm having a first hook protruding into the mounting hole. The first hook is lockable with the key member in order to prevent the key member from withdrawing from the mounting hole. The key member further defines a slit through which the first hook is forwardly exposed to an exterior. As a result, a tool can be inserted into the slit to push the first hook so as to unlock the first locking arm with the key member.

20 Claims, 11 Drawing Sheets

POWER CONNECTOR WITH IMPROVED LOCKING MEMBER EXPOSED TO THE EXTERIOR

BACKGROUND OF THE INVENTION

1. Field of the Invention

The present invention relates to a power connector, and more particularly to a power connector with an improved locking member exposed to the exterior for easy separation.

2. Description of Related Art

Power connectors are usually required to have characteristics of enduring heavy electric current and high voltage. However, when the power connectors are mounted to a system device, it is sometimes difficult for single parts of the power connectors to identify multiple voltages and electric current, because the system device works under different input/output voltage and different electric current. In order to resolve this problem, key members are developed by designers and used in power connectors for ensuring right mating with complementary power connectors.

U.S. Patent Publication No. 2010/0087100A1 published to De Blieck et al. on Apr. 8, 2010 discloses such a power connector including an insulative housing, a plurality of contacts fixed in the insulative housing and a key member. Referring to FIG. 2 of this patent publication, the key member includes a middle portion, a pair of locking arms extending backwardly from the middle portion, and a protrusion extending forwardly from the middle portion. The insulative housing defines a mounting hole for assembly of the key member. However, once the locking arms are assembled to the insulative housing, it is difficult to separate them from the mounting hole, because the locking arms are hidden in the insulative housing. As a result, it is difficult to replace the key member when it is damaged or need to be changed.

Hence, a power connector with improved locking member is desired.

BRIEF SUMMARY OF THE INVENTION

The present invention provides a power connector including an insulative housing, at least one power contact retained in the insulative housing and a key member. The insulative housing includes a mating face, a receiving chamber recessed from the mating face and a rear portion located at the rear of the receiving chamber. The rear portion defines a mounting hole in communication with the receiving chamber and a first locking arm comprising a first hook protruding into the mounting hole. The power contact includes a contacting portion protruding into the receiving chamber. The key member includes a retaining portion fixed in the mounting hole and a protrusion extending into the receiving chamber. The first hook is lockable with the retaining portion in order to prevent the retaining portion from withdrawing from the mounting hole. The protrusion defines a slit through which the first hook is forwardly exposed to an exterior. As a result, a tool can be inserted in the slit to push the first hook so as to unlock the first locking arm with the retaining portion.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENTS

Figure 1:
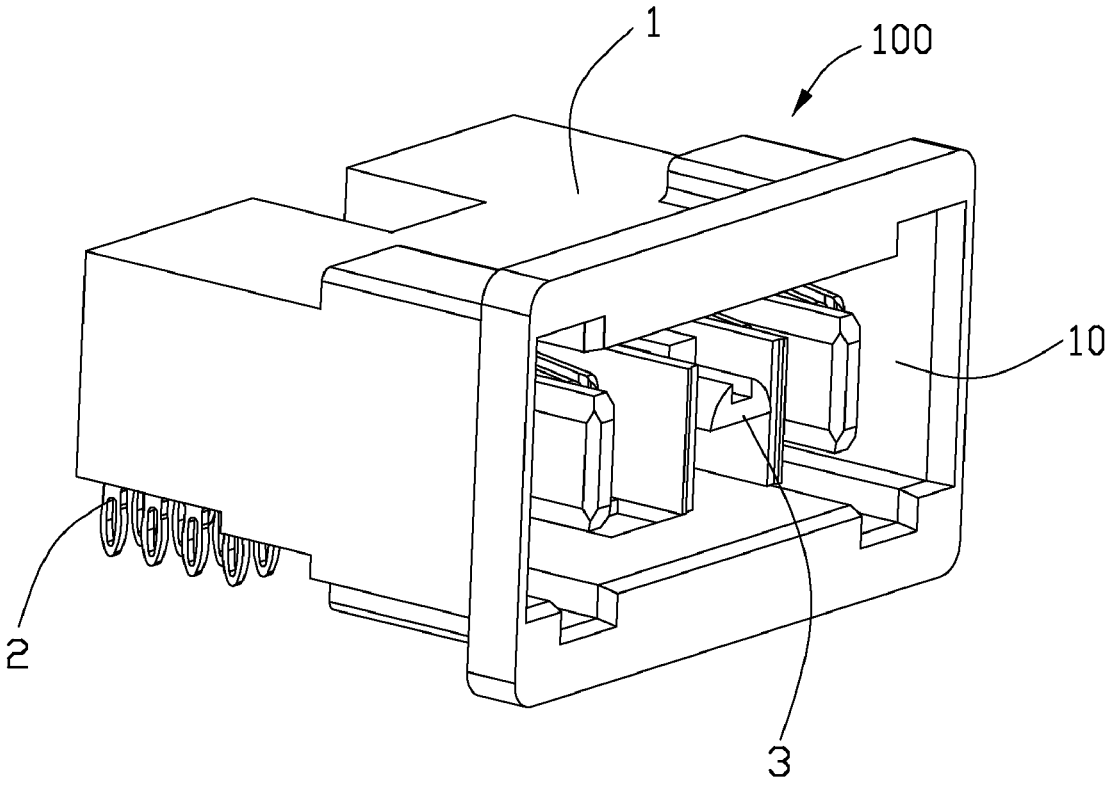
FIG. 1 is a perspective view of a power connector in accordance with an embodiment of the present invention.
Figure 2:
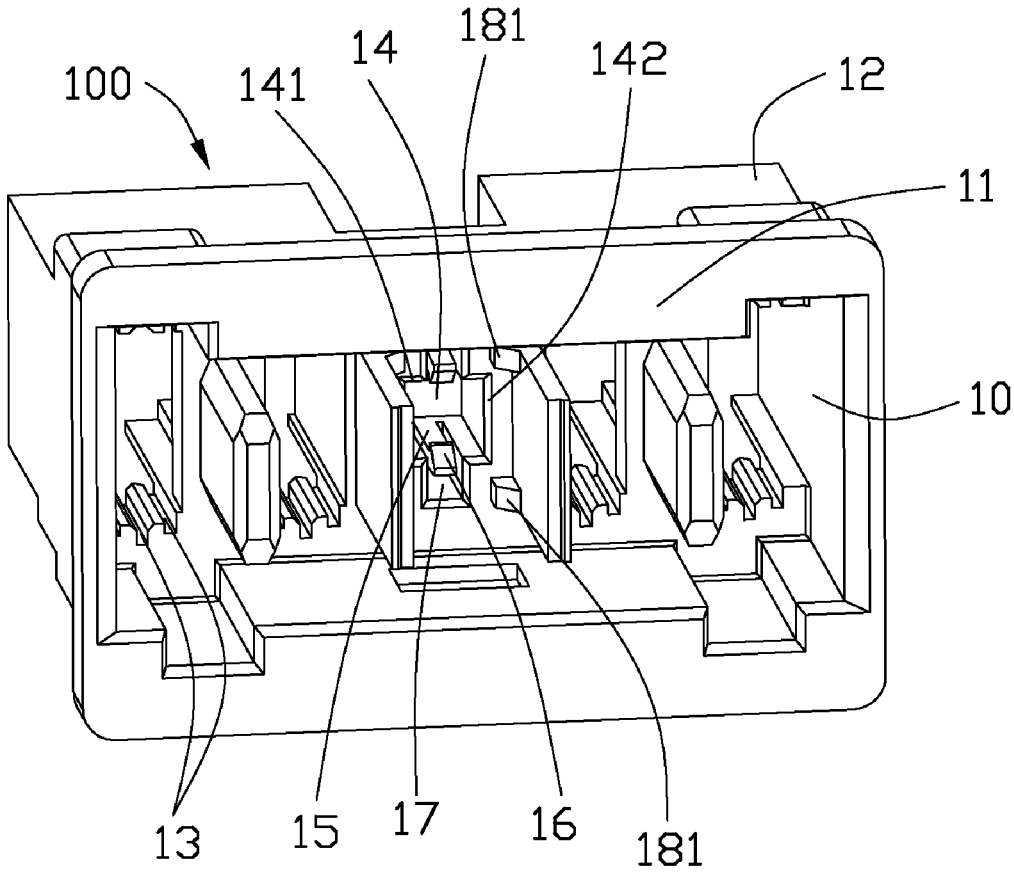
FIG. 2 is a perspective view of the power connector similar to FIG. 1, while taken from another aspect.
Figure 3:
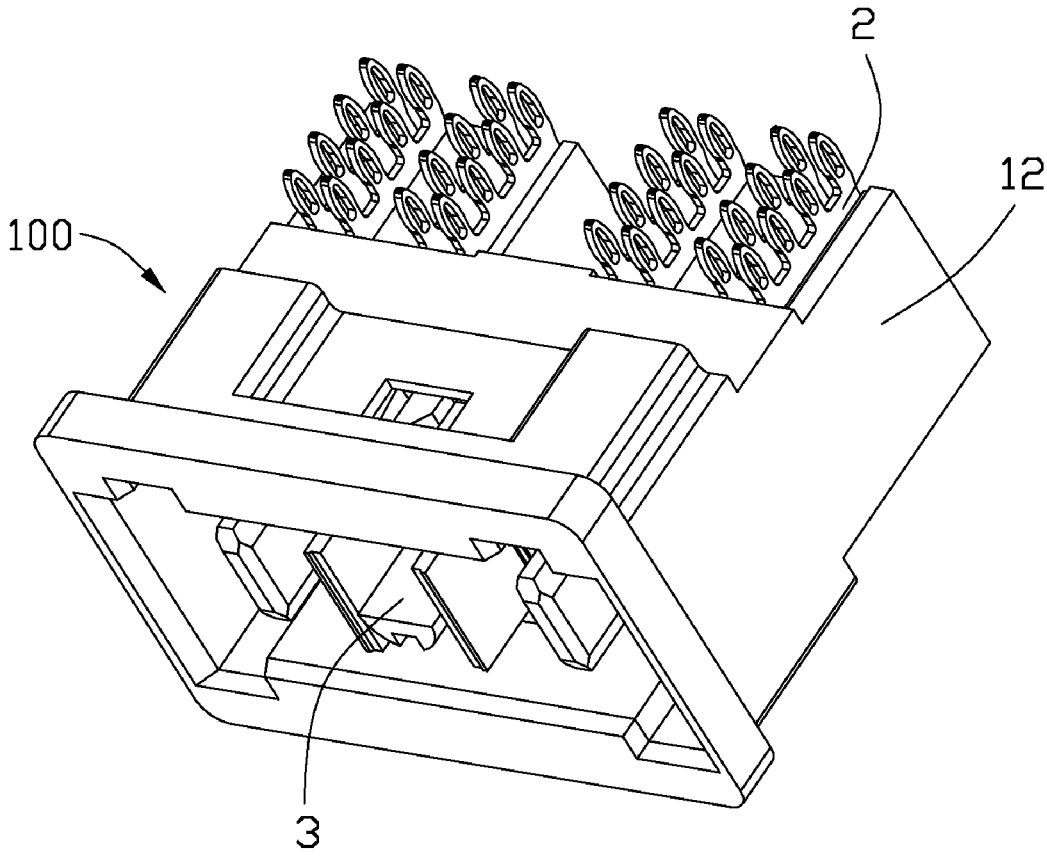
FIG. 3 is another perspective view of the power connector, but viewed from another aspect.

Reference will now be made to the drawing figures to describe the preferred embodiment of the present invention in detail. FIGS. 1 to 3 illustrate a power connector 100 including an insulative housing 1, a plurality of power contacts 2 retained in the insulative housing 1 and a key member 3 assembled to the insulative housing 1 along a front-to-rear direction. The key member 3 is adapted for ensuring right mating with a mating connector (not shown).

Figure 7:
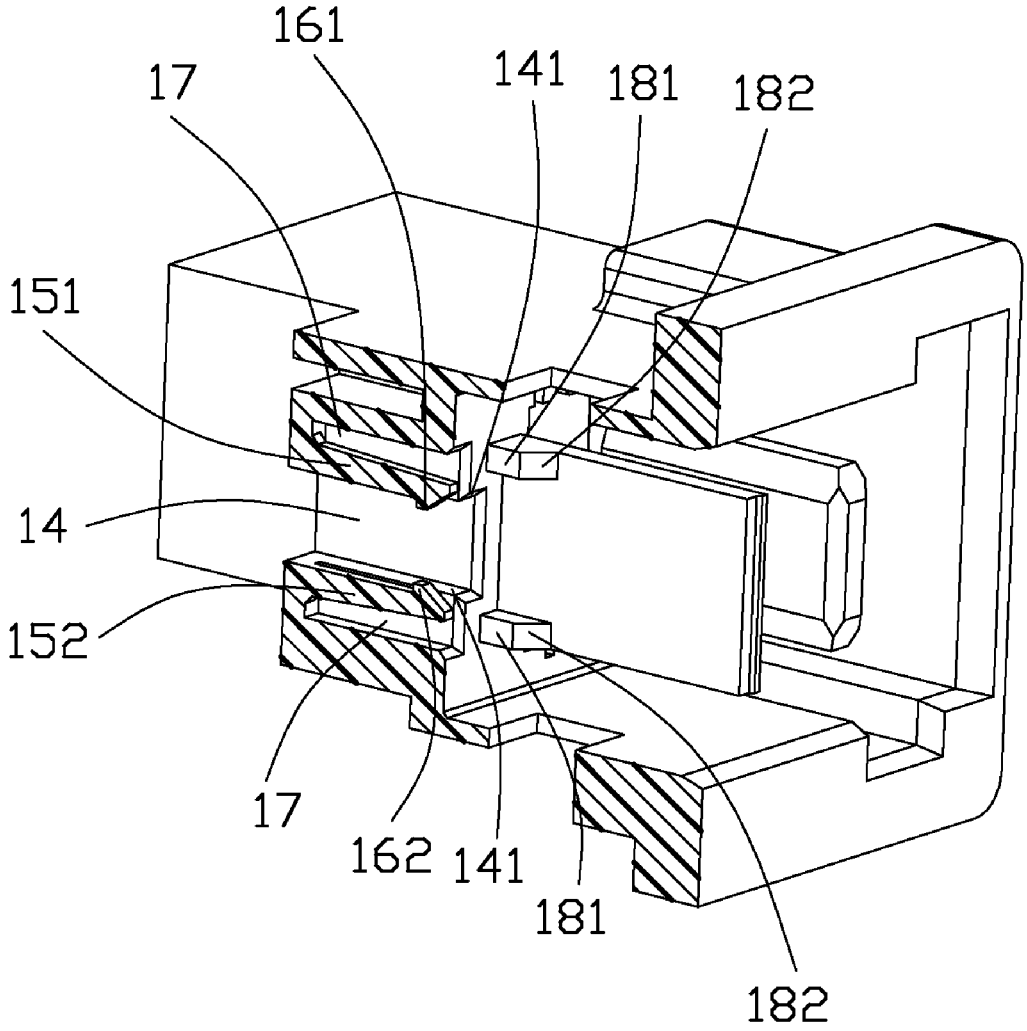
FIG. 7 is a part perspective view of an insulative housing of the power connector as shown in FIG. 1.
Figure 8:
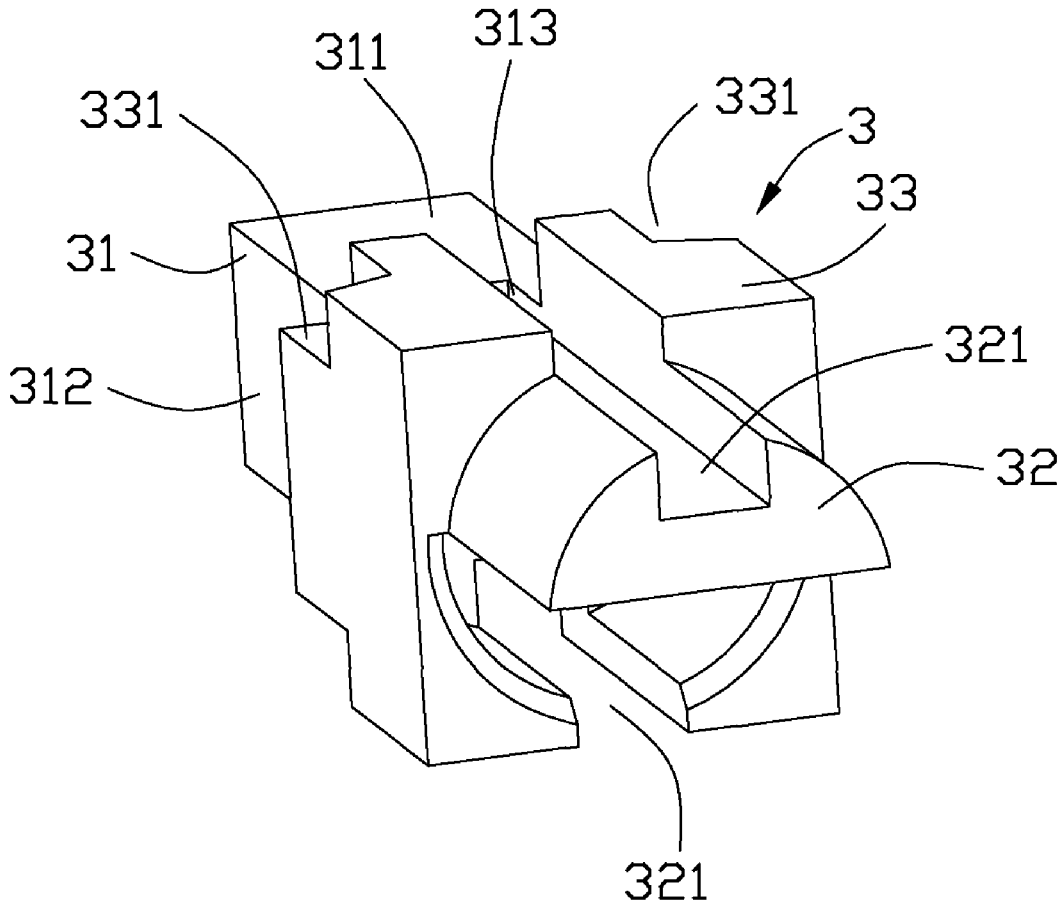
FIG. 8 is a perspective view of a key member of the power connector.
Figure 9:
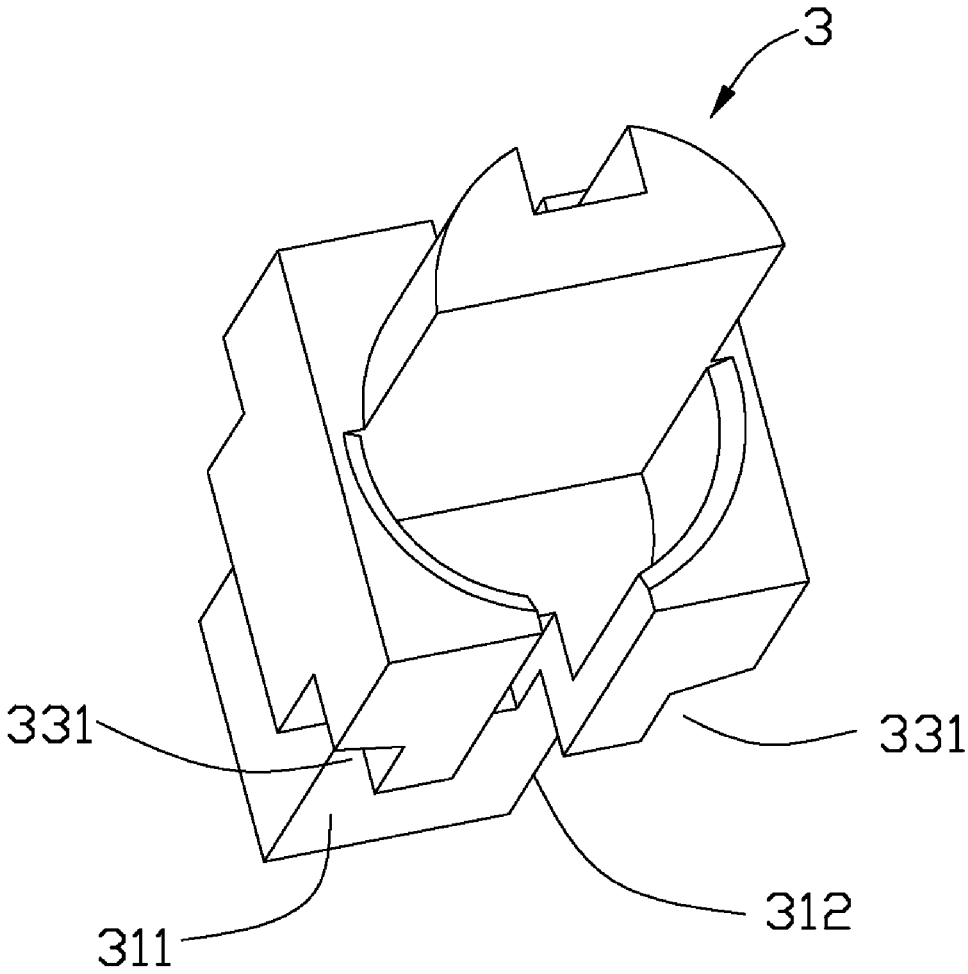
FIG. 9 is another perspective view of the key member, while taken from another aspect.
Figure 10:
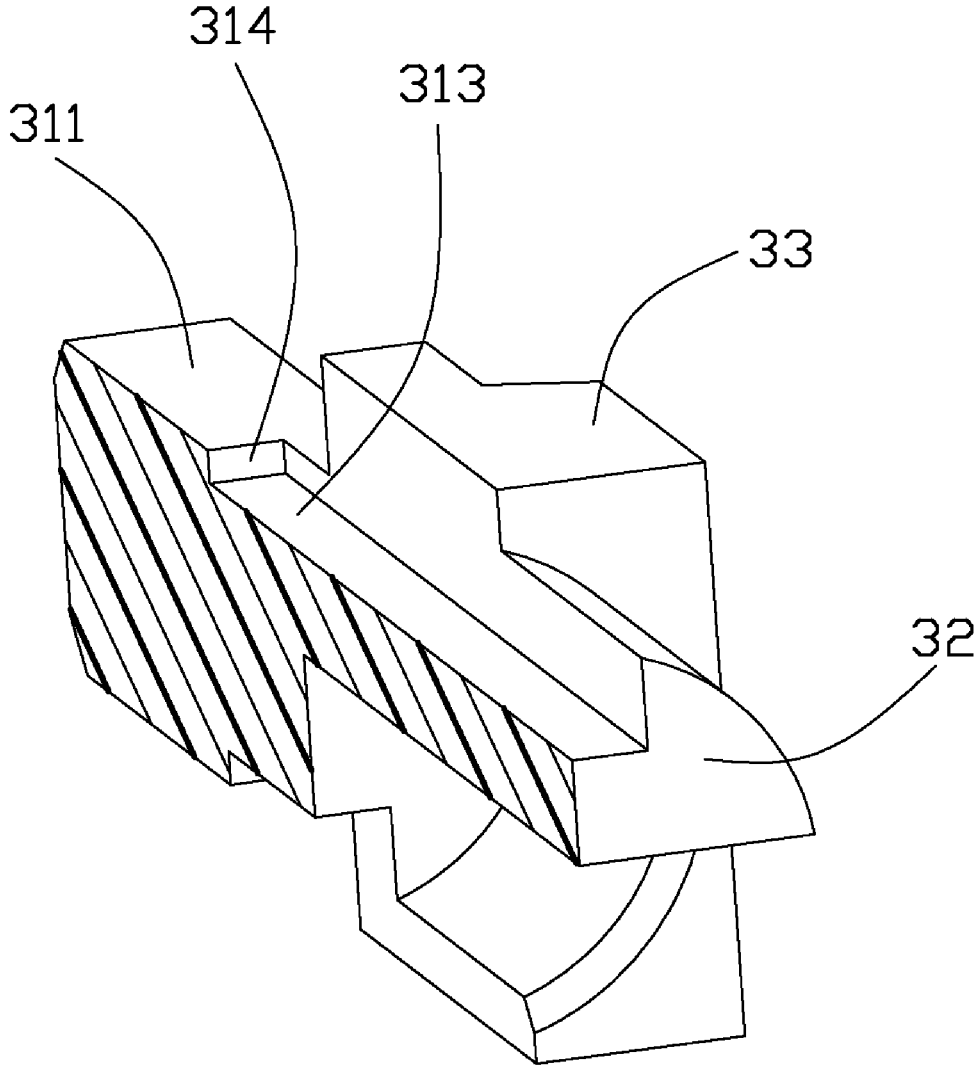
FIG. 10 is a part perspective view of the key member which has been partly removed.
Figure 11:
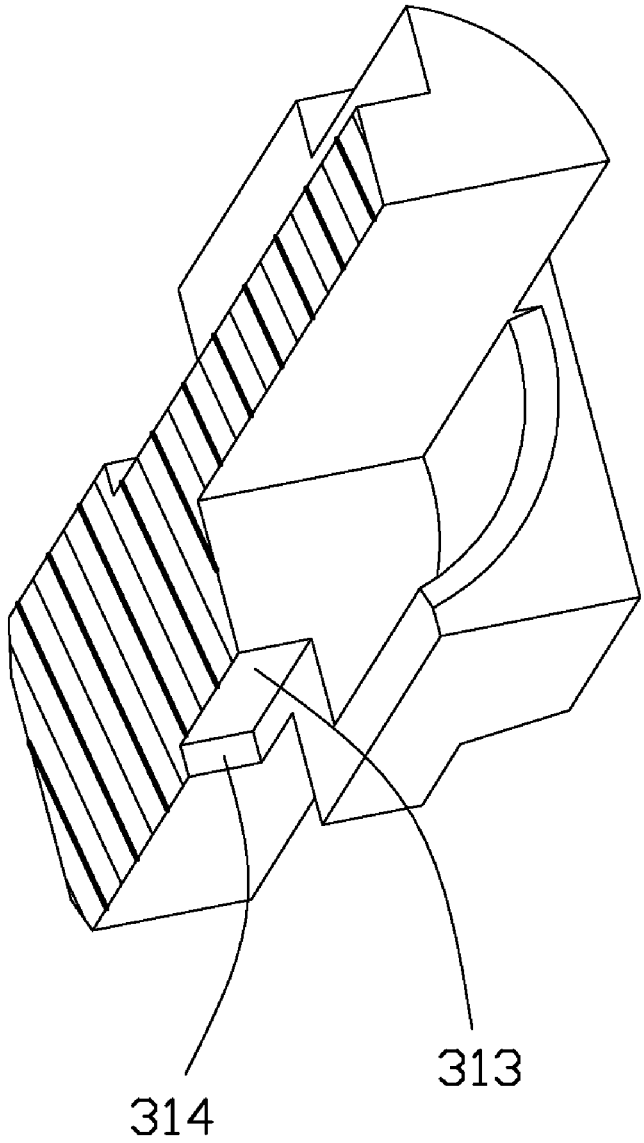
FIG. 11 is another part perspective view of the key member, but viewed from another aspect.

Referring to FIG. 2, the insulative housing 1 includes a mating face 11, a receiving chamber 10 recessed from the mating face 11 for accommodating the mating connector, and a rear portion 12 located at the rear of the receiving chamber 10. The rear portion 12 defines a plurality of passageways 13 extending therethrough along the front-to-rear direction for receiving the power contacts 2. A mounting hole 14 is defined through the rear portion 12 for receiving the key member 3. The mounting hole 14 is in communication with the receiving chamber 10. Besides, the rear portion 12 includes a locking member 15 which includes a locking hook 16 protruding into the mounting hole 14 for locking with the key member 3. Referring to FIG. 7, according to the preferred embodiment of the present invention, the locking member 15 includes a first locking arm 151 and a second locking arm 152 located under the first locking arm 151. The locking hook 16 includes a first hook 161 formed at a distal end of the first locking arm 151, and a second hook 162 formed at a distal end of the second locking arm 152. The rear portion 12 defines a pair of deformation spaces 17 communicating with the first and the second locking arms 151, 152, respectively, for elastic deformation of the first and the second locking arms 151, 152.

Figure 4:
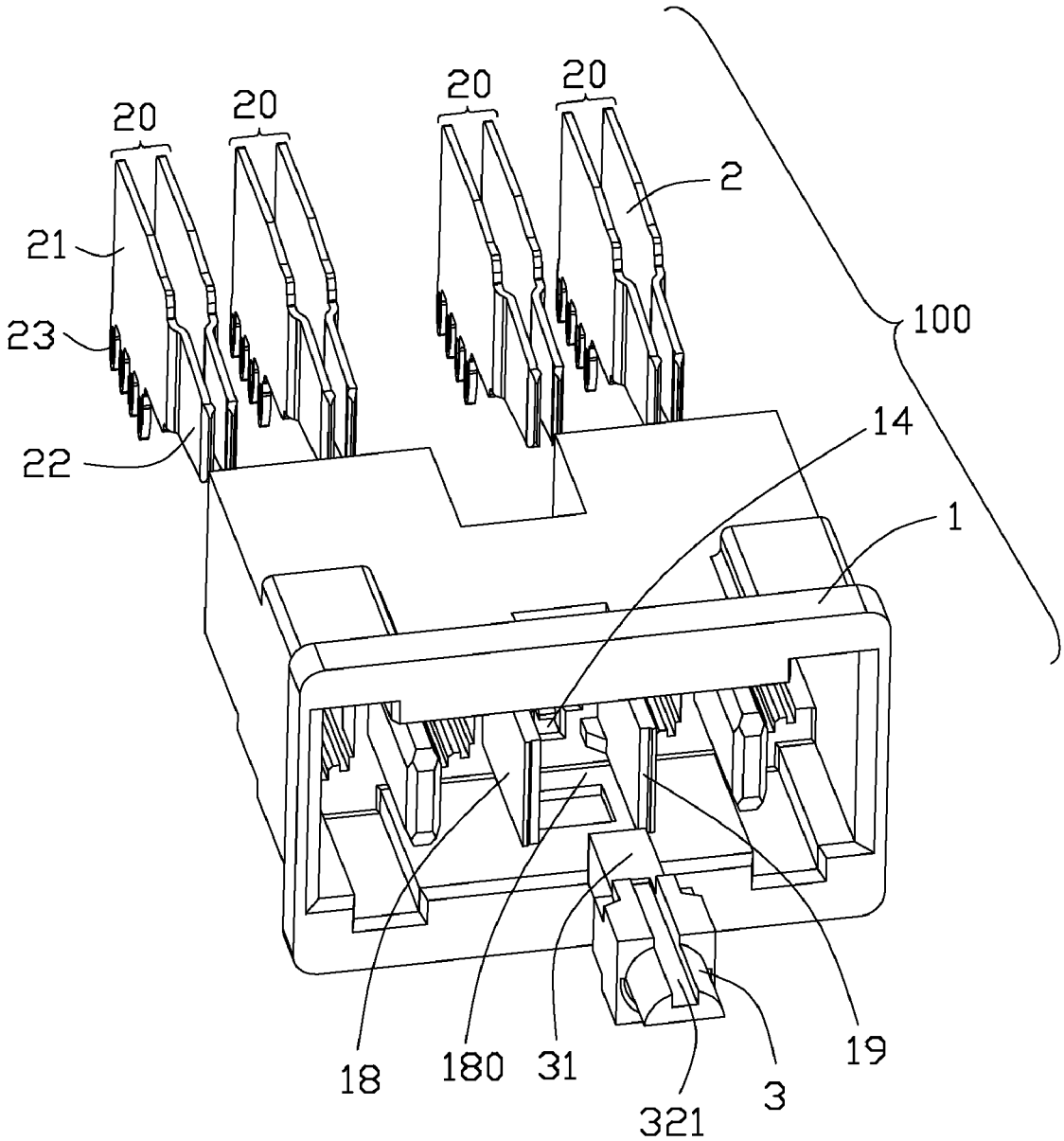
FIG. 4 is an exploded view of the power connector as shown in FIG. 2.
Figure 5:
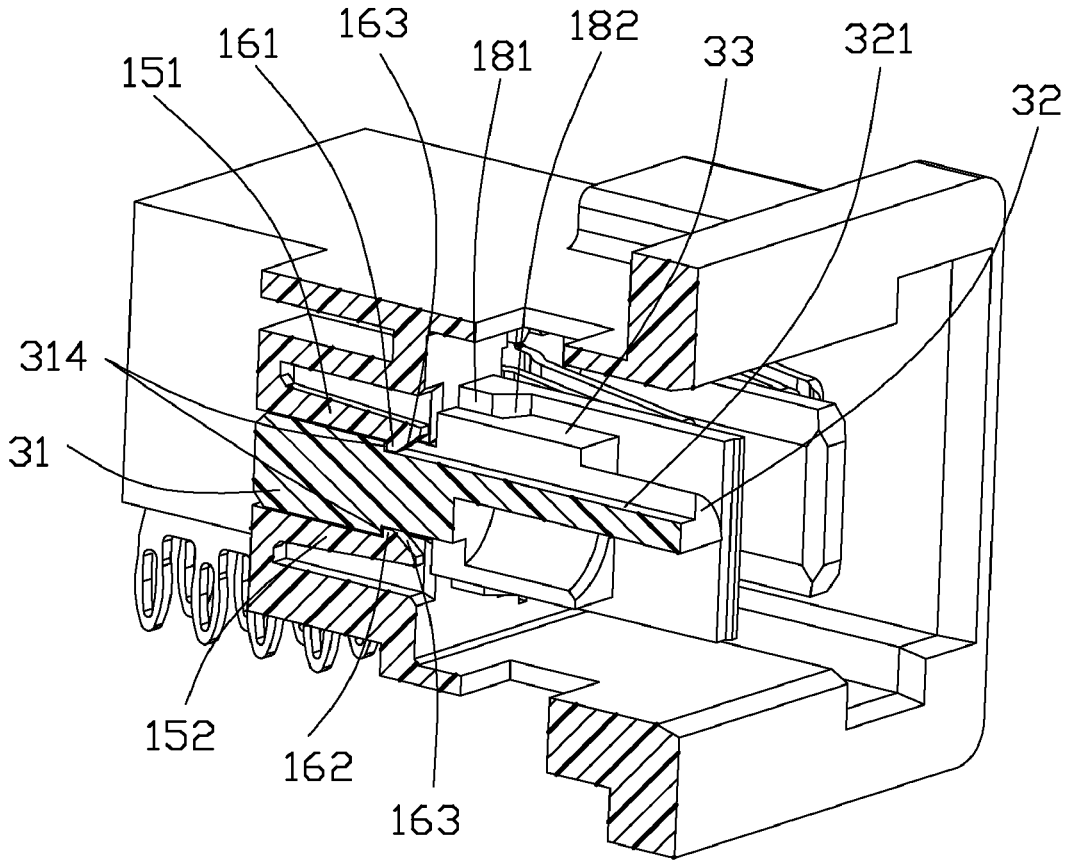
FIG. 5 is a part perspective view of the power connector as shown in FIG. 1 when part of the power connector has been cut out.

Referring to FIG. 4, the insulative housing 1 includes a pair of guiding plates 18, 19 protruding into the receiving chamber 10. The pair of guiding plates 18, 19 are located at opposite sides of the mounting hole 14 and define a guiding passageway 180 in communication with the mounting hole 14 in order to guide insertion of the key member 3 into the mounting hole 14. The pair of guiding plates 18, 19 are mainly located in parallel vertical planes. As shown in FIGS. 2, 5 and 7, each guiding plate 18, 19 includes a pair of upper and lower blocks 181 to restrict the key member 3 along a vertical direction. Each block 181 includes an inclined guiding surface 182 for guiding insertion of the key member 3.

Referring to FIG. 2, the mounting hole 14 is polygonal and is configured to receive the key member 3 in order to prevent relative rotary of the key member 3 and the mounting hole 14. According to the preferred embodiment of the present invention, the mounting hole 14 is rectangular and is restricted by a pair of flat and opposite first locating surfaces 141 and a pair of flat and opposite second locating surfaces 142 which are perpendicular to the first locating surfaces 141. As shown in FIG. 7, the first and the second hooks 161, 162 extend beyond the first locating surfaces 141 and into the mounting hole 14.

Referring to FIG. 4, each power contact 2 is flat for easy manufacture and includes a fixation portion 21 retained in the corresponding passageway 13, a contacting portion 22 extending from the fixation portion 21 into the receiving chamber 10, a plurality of mounting tails 23 downwardly extending from the fixation portion 21 for being mounted to a PCB. Adjacent power contacts 2 consist of a contact pair 20 for mating with the mating connector. In each contact pair 20, a space between adjacent contacting portions 22 is smaller than that between adjacent fixation portions 21.

Referring to FIGS. 8 to 11, the key member 3 includes a retaining portion 31 received in the mounting hole 14, a protrusion 32 protruding into the receiving chamber 10, and a middle portion 33 connecting the retaining portion 31 and the protrusion 32. The outer surfaces of the retaining portion 31 are polygonal and configured to be received in the mounting hole 14. According to the preferred embodiment of the present invention, the retaining portion 31 is rectangular and comprises a pair of flat and opposite first mating surfaces 311 and a pair of flat and opposite second mating surfaces 312 which are perpendicular to the first mating surfaces 311. A pair of upper and lower slots 313 are recessed from the first mating surfaces 311 in order to form a pair of vertical locking surfaces 314. Besides, a pair of slits 321 are formed in communication with the slots 313 and extend forwardly through a distal end of the protrusion 32. The middle portion 33 is wider and higher than the retaining portion 31 and the protrusion 32. Besides, a plurality of cutouts 331 are formed at four corners of the middle portion 33.

As shown in FIG. 5, each of the first and the second hooks 161, 162 includes an inclined surface 163 exposed to the corresponding slits 321 and the receiving chamber 10. The first and the second locking arms 151, 152 are outwardly deformable in the deformation spaces 17 when the inclined surfaces 163 are pushed by a tool (not shown). The tool can be provided with a pair of parallel beams (not shown) extending horizontally along the front-to-rear direction. As a result, the first and the second hooks 161, 162 unlock with the vertical locking surfaces 314.

Figure 6:
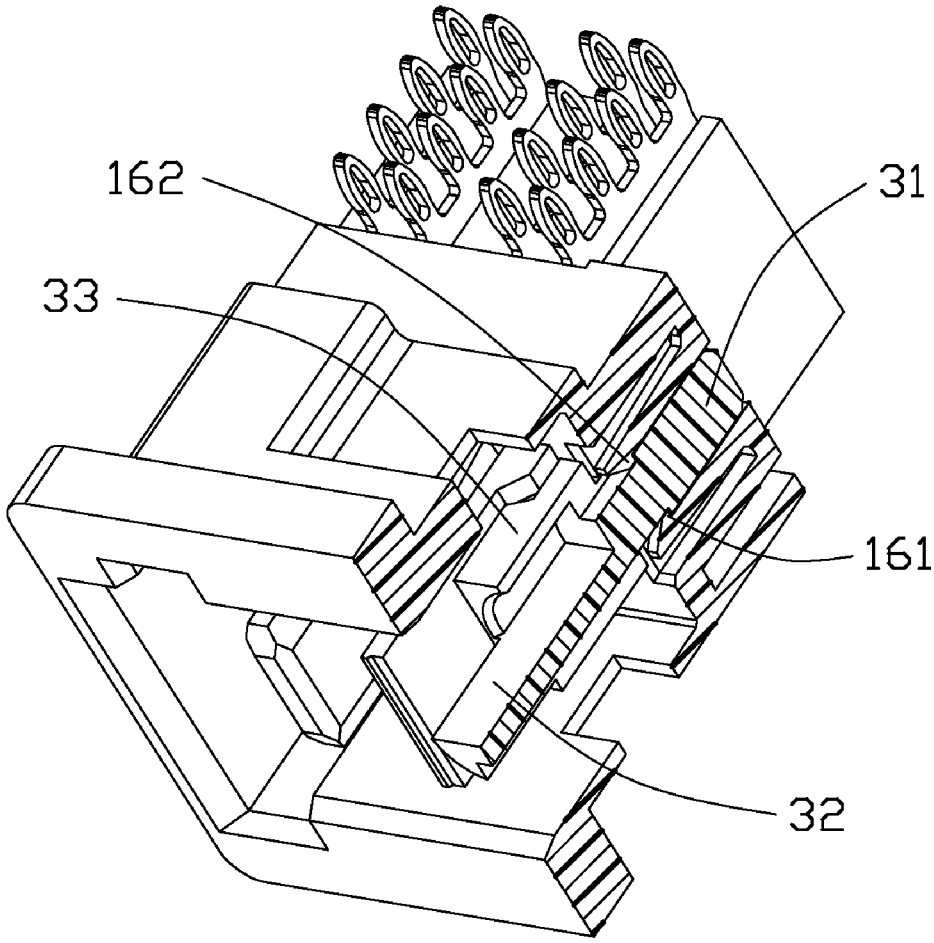
FIG. 6 is another part perspective view of the power connector as shown in FIG. 3 when part of the power connector has been cut out.

Referring to FIGS. 4 to 6, when the key member 3 is assembled to the insulative housing 1, the retaining portion 31 of the key member 3 is guided by the pair of guiding plates 18, 19. The first and the second mating surfaces 311, 312 are received in the mounting hole 14 along the first and the second locating surfaces 141, 142, respectively. In such process, the first and the second mating surfaces 311, 312 press against the first and the second hooks 161, 162, respectively, so that the first and the second locking arms 151, 152 are deformable in the deformation spaces 17. When the key member 3 is inserted to reach the final position, the first and the second hooks 161, 162 are released to protrude into the slots 313. Under this condition, the first and the second hooks 161, 162 abut against the vertical locking surfaces 314 in order to prevent the retaining portion 31 from withdrawing from the mounting hole 14. The retaining portion 31 is jointly clipped by the first and the second locking arms 151, 152. Besides, the pair of first and the second hooks 161, 162 compared with one hook can reinforce the retaining portion 31 received in the mounting hole 14. The blocks 181 of the guiding plates 18, 19 are received in the cutouts 331 of the middle portion 33.

Since the rectangular retaining portion 31 is received in the rectangular mounting hole 14 with the first and the second mating surfaces 311, 312 abutting against the first and the second locating surfaces 141, 142, relative larger and stronger pressing surfaces can be provided. Such pressing surfaces can endure big torque in order to prevent the rotary of the retaining portion 31 with respect to the mounting hole 14. Besides, when the key member 3 rotates 90 or 180 degrees, it can still be inserted into the mounting hole 14. As a result, different mounting positions of the same key member 3 can be realized.

Because the first and the second hooks 161, 162 are horizontally and forwardly exposed to the exterior through the slits 321, it is obvious that the tool can be easily inserted into the slits 312 to push the inclined surfaces 163. With the beams of the tool inserted into the slits 312, the first and the second locking arms 151, 152 are outwardly driven as a result that the first and the second hooks 161, 162 unlock with the retaining portion 31. According to the present invention, the key member 3 can be easily taken off from the mounting hole 14 by using the tool. It is sufficient when the key member 3 is broken and needed to be replaced, or the key member 3 is needed to rotate a certain degree for multiple usage.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power connector comprising:

an insulative housing comprising a mating face, a receiving chamber recessed from the mating face and a rear portion located at the rear of the receiving chamber, the rear portion defining a mounting hole in communication with the receiving chamber and a first locking arm comprising a first hook protruding into the mounting hole;

at least one power contact with a contacting portion protruding into the receiving chamber; and a key member comprising a retaining portion fixed in the mounting hole and a protrusion extending into the receiving chamber, the first hook being lockable with the retaining portion in order to prevent the retaining portion from withdrawing from the mounting hole; wherein the protrusion defines a slit through which the first hook is forwardly exposed to an exterior.

2. The power connector as claimed in claim 1, wherein the first hook is located at a distal end of the first locking arm.

3. The power connector as claimed in claim 2, wherein the retaining portion defines a slot on an outer wall thereof in order to form a vertical locking surface abutting against the first hook.

4. The power connector as claimed in claim 3, wherein the rear portion defines a deformation space adjacent to the first locking arm, the first hook comprising an inclined surface exposed to the slit, the first locking arm being outwardly deformable in the deformation space to unlock with the vertical locking surface when the inclined surface is pushed.

5. The power connector as claimed in claim 1, wherein the rear portion comprises a second locking arm opposite to the first locking arm under a condition that the retaining portion of the key member is jointly clipped by the first and the second locking arms.

6. The power connector as claimed in claim 5, wherein the second locking arm is located under the first locking arm and comprises a second hook formed at a distal end thereof to be lockable with the retaining portion.

7. The power connector as claimed in claim 1, wherein the insulative housing comprises a pair of guiding plates protruding into the receiving chamber, the pair of guiding plates being located at opposite sides of the mounting hole and defining a guiding passageway in communication with the mounting hole in order to guide insertion of the retaining portion into the mounting hole.

8. The power connector as claimed in claim 7, wherein the key member comprises middle portion connecting the retaining portion and the protrusion, the pair of guiding plates being located in parallel vertical planes, each guiding plate comprising an upper block and a lower block to restrict the middle portion between the upper and the lower blocks along a vertical direction.

9. The power connector as claimed in claim 1, wherein the slit extends forwardly and horizontally through a distal end of the protrusion.

10. The power connector as claimed in claim 1, wherein the mounting hole is polygonal and is configured to receive the retaining portion in order to prevent relative rotary of the retaining portion and the mounting hole.

11. The power connector as claimed in claim 10, wherein the mounting hole is restricted by a first locating surface and a second locating surface, the retaining portion of the key member comprising first and second mating surfaces abutting against the first and the second locating surfaces, respectively.

12. The power connector as claimed in claim 11, wherein the mounting hole is rectangular as well as the retaining portion, the first and the second locating surfaces being flat and perpendicular to each other.

13. A power connector comprising:

an insulative housing comprising a mating face, a receiving chamber recessed from the mating face and a rear portion located at the rear of the receiving chamber, the rear portion defining a mounting hole in communication with the receiving chamber and a first locking arm comprising a first hook exposed to the receiving chamber;

at least one power contact with a contacting portion protruding into the receiving chamber; and a key member comprising a retaining portion fixed in the mounting hole and a protrusion extending into the receiving chamber, the first hook being lockable with the retaining portion in order to prevent the retaining portion from withdrawing from the mounting hole; wherein the first locking arm is deformable to unlock with the retaining portion by a tool pushing the first hook.

14. The power connector as claimed in claim 13, wherein receiving chamber includes a slit extending forwardly and horizontally through a distal end of the protrusion, the first hook being exposed to the slit along which the tool is inserted.

15. The power connector as claimed in claim 13, wherein the first hook is located at a distal end of the first locking arm.

16. The power connector as claimed in claim 15, wherein the rear portion defines a deformation space adjacent to the first locking arm, the first hook comprising an inclined surface exposed to the receiving chamber, the first locking arm being outwardly deformable in the deformation space to unlock with the retaining portion when the inclined surface is pushed by the tool.

17. The power connector as claimed in claim 13, wherein the rear portion comprises a second locking arm opposite to the first locking arm under a condition that the retaining portion of the key member is jointly clipped by the first and the second locking arms.

18. The power connector as claimed in claim 17, wherein the second locking arm is located under the first locking arm and comprises a second hook formed at a distal end thereof to be lockable with the retaining portion.

19. The power connector as claimed in claim 13, wherein the insulative housing comprises a pair of guiding plates protruding into the receiving chamber, the pair of guiding plates being located at opposite sides of the mounting hole and defining a guiding passageway in communication with the mounting hole in order to guide insertion of the retaining portion into the mounting hole.

20. The power connector as claimed in claim 13, wherein the mounting hole is polygonal and is configured to receive the retaining portion in order to prevent relative rotary of the retaining portion and the mounting hole.

* * * * *